US011492769B2

(12) United States Patent
Toews

(10) Patent No.: US 11,492,769 B2
(45) Date of Patent: Nov. 8, 2022

(54) CROSS-COUNTRY SKI TRAIL GROOMING DEVICE AND METHOD

(71) Applicant: Richard J. Toews, Lancaster, PA (US)

(72) Inventor: Richard J. Toews, Lancaster, PA (US)

( * ) Notice: Subject to any disclaimer, the term of this patent is extended or adjusted under 35 U.S.C. 154(b) by 713 days.

(21) Appl. No.: 16/439,918

(22) Filed: Jun. 13, 2019

(65) Prior Publication Data

US 2020/0392683 A1 Dec. 17, 2020

(51) Int. Cl.
*E01H 4/02* (2006.01)
*A63C 11/00* (2006.01)

(52) U.S. Cl.
CPC ..... *E01H 4/02* (2013.01); *A63C 11/00* (2013.01)

(58) Field of Classification Search
CPC ..... E01H 4/02; A63C 5/003; A63C 13/005; A63C 11/20; A63C 11/18; A63C 11/00
See application file for complete search history.

(56) References Cited

U.S. PATENT DOCUMENTS 3,687,472 A * 8/1972 Struble, Jr. ..... A63C 11/22 280/820
4,110,919 A * 9/1978 Henrichon ..... E01H 4/02 37/219
4,122,614 A 10/1978 Cheney
4,271,612 A * 6/1981 Mellingen ..... E01H 4/02 37/219
4,519,470 A * 5/1985 Allisio ..... B62D 55/07 180/9.4
4,560,303 A 12/1985 Haug et al.
(Continued)

FOREIGN PATENT DOCUMENTS

DE 1803676 A1 4/1970
DE 2835795 A1 2/1980
(Continued)

*Primary Examiner* — Thomas B Will
*Assistant Examiner* — Joan D Misa
(74) *Attorney, Agent, or Firm* — Saxton & Stump, LLC

(57) ABSTRACT

A device attachable to a pair of cross-country skis for grooming a trail in fresh snow simply by skiing the first pass. The purpose of this invention is to create a grooved trail in fresh snow to guide all skiers that follow in the same track. Without this attachment installed on the lead skier's ski, the soft snow on each side of the packed ski track does not help to keep the subsequent skier's ski in the lead skier's track. For them, it is like trying to ski on top of a narrow rail. This creates a situation where the skier must be diligent to stay in the track. With this device installed on the lead skiers ski, the subsequent skiers are guided by the packed snow on the sides of the lead skier's ski track. When skiing in tracks made using this invention, a skier can ski faster and smoother than in untracked snow. Since the compacted track helps guide the skier in the track, it allows the skier to focus on, and enjoy, the surroundings scenery. Another unique characteristic of this invention is its 2-part construction that allows the trail-making portion of the invention to be added and/or removed at any time. This allows the skier to easily change from being the lead skier to being a following skier. Or, if skiing alone, to return without the trail-making attachment, along the track he or she previously made.

18 Claims, 6 Drawing Sheets

(56) References Cited

U.S. PATENT DOCUMENTS

| | | | | | |
|---|---|---|---|---|---|
| 4,735,436 | A * | 4/1988 | Rogalski | A63C 11/00 | 441/71 |
| 4,756,100 | A | 7/1988 | Holden | | |
| 6,158,747 | A * | 12/2000 | Magnani | A63C 5/075 | 280/602 |
| 6,419,242 | B1 * | 7/2002 | Bauer | A63C 11/00 | 280/14.22 |
| 6,776,088 | B2 * | 8/2004 | Halt | G09F 7/12 | 37/219 |
| 6,945,563 | B2 * | 9/2005 | Clausing | A63C 5/052 | 280/809 |
| 6,969,076 | B2 * | 11/2005 | Spiers | B62B 13/16 | 280/14.28 |
| 9,956,982 | B1 * | 5/2018 | Gagnon | B62M 27/02 | |
| 2005/0212258 | A1 * | 9/2005 | Enders | A63C 5/128 | 280/602 |

FOREIGN PATENT DOCUMENTS

| | | | |
|---|---|---|---|
| DE | 9216222.3 | U1 | 3/1993 |
| DE | 20201963 | U1 | 8/2002 |
| EP | 57743 | A1 | 8/1982 |
| FR | 2527085 | A1 | 11/1983 |
| WO | 9111230 | A1 | 8/1991 |

* cited by examiner

CROSS-COUNTRY SKI TRAIL GROOMING DEVICE AND METHOD

BACKGROUND OF THE INVENTION

The present invention relates generally to grooming cross-country ski tracks in the snow and, more particularly, to a device attachable to a user's skis that allows cross-country ski tracks to be formed as the user's first traverses the snow so that groomed tracks will exist for skiers following or subsequent passes by the user.

Cross-country skiing is best enjoyed when a track comprising a pair of parallel indentations (tracks) are compressed into the snow, the width thereof being generally the same as the width the ski. A wider track of lesser-compacted snow surrounds each track to prevent the skier's boots, which typically overhang a cross-country ski, from dragging in loose snow and makes following the track easier for subsequent skiers. Trail grooming and track formation are typically performed by a sled-like apparatus having a large, sliding surface with a pair of parallel ribs projecting downwardly to compress ski tracks into the groomed snow surface. The grooming sleds may be towed by any number of vehicles, including snow-cats and snowmobiles. While such equipment may be practical for businesses and parks, individual skiers are typically not equipped to handle such an equipment investment making track grooming by individuals for their own benefit impractical.

It would be advantageous to provide a device that could be selectively attachable to a user's skis and allow the user to groom a cross-country ski track for his/her own benefit or for that of skiers following behind. Additional benefits would be derived if the device could be economically produced and accessible for use by any skier. Still more advantages would be derived from a device for grooming cross-country ski tracks to allow skiers to easily install or remove the grooming device, preferably toollessly.

SUMMARY OF THE INVENTION

Accordingly, the present invention, in any of the embodiments described herein, may provide one or more of the following advantages:

It is an object of the present invention to provide a device that is selectively attachable to a user's cross-country skis that enables the user to form a groomed cross-country ski track in fresh snow by skiing a first pass in the snow. A grooming device is attached to each of the user's skis to compact and groom snow laterally adjacent to the ski while the ski itself further compacts the snow to create a ski track within the groomed area. The compacted and groomed snow adjacent to the ski track helps to guide subsequent skier's skis to keep them in the ski track.

It is another object of the present invention to provide a device that enables an individual user to create a groomed track for cross-country skiing simply by making a first pass along a desired path. The device eliminates the need for a complex grooming apparatus or a prime mover with which to tow the grooming apparatus along the path. The resulting groomed track for cross-country skiing is surrounded by snow that it undisturbed by the towing equipment. The device also allows ski track grooming along paths that may not be wide enough to be accessible by conventional towed grooming equipment.

It is another object of the present invention to provide a device enabling a skier to groom a cross-country ski track while skiing that is easily installed and removed from a user's skis thereby minimizing impact on use of the skis and minimizing the need for dedicated equipment, such as skis, for grooming ski tracks.

It is a further object of the present invention to provide a device and a method for easily creating groomed cross-country ski tracks that improve skiing conditions for subsequent users of the tracks. A compacted ski track having area of slightly compacted snow laterally adjacent to the ski track provides a ski track that is easily followed by other skiers thereby improving their ski experience.

It is a still further object of the present invention to provide a device and a method for easily creating groomed cross-country ski tracks that is inexpensive of manufacture, and simple and effective to use.

These and other objects of the present invention are fulfilled by a device attachable to a pair of cross-country skis for grooming a trail in fresh snow simply by skiing the first pass. The purpose of this invention is to create a grooved trail in fresh snow to guide all skiers that follow in the same track. Without this attachment installed on the lead skier's ski, the soft snow on each side of the packed ski track does not help to keep the subsequent skier's ski in the lead skier's track. For them, it is like trying to ski on top of a narrow rail. This creates a situation where the skier must be diligent to stay in the track. With this device installed on the lead skiers ski, the subsequent skiers are guided by the packed snow on the sides of the lead skier's ski track. When skiing in tracks made using this invention, a skier can ski faster and smoother than in untracked snow. Since the compacted track helps guide the skier in the track, it allows the skier to focus on, and enjoy, the surroundings scenery. Another unique characteristic of this invention is its 2-part construction that allows the trail-making portion of the invention to be added and/or removed at any time. This allows the skier to easily change from being the lead skier to being a following skier. Or, if skiing alone, to return without the trail-making attachment, along the track he or she previously made.

BRIEF DESCRIPTION OF THE DRAWINGS

The advantages of this invention will be apparent upon consideration of the following detailed disclosure of the invention, especially when taken in conjunction with the accompanying drawings wherein.

DESCRIPTION OF THE PREFERRED EMBODIMENT(S)

Figure 1:
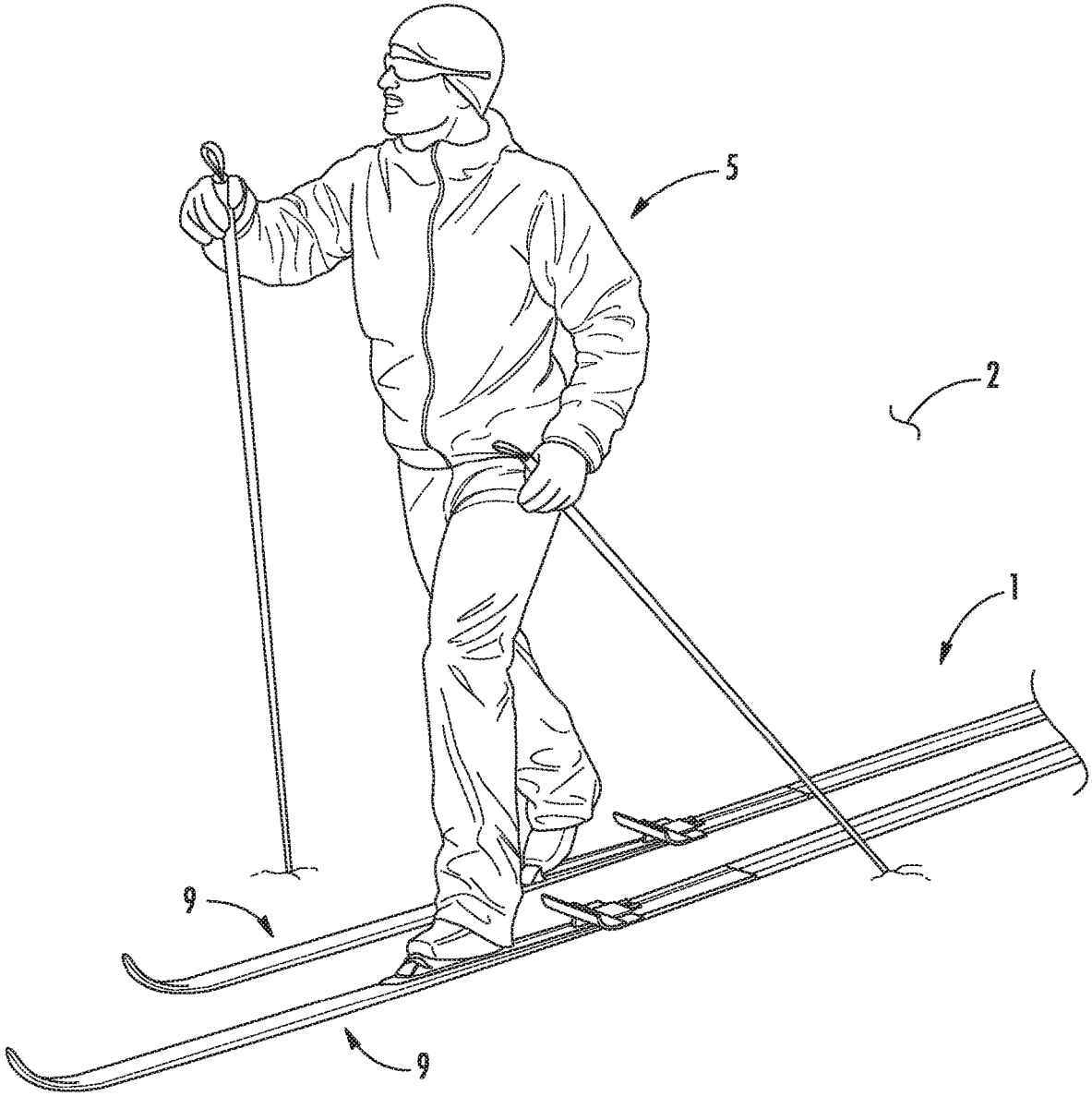
FIG. 1 illustrates a cross-country skier using the present invention to create a ski track in a snow-covered surface.
Figure 2:
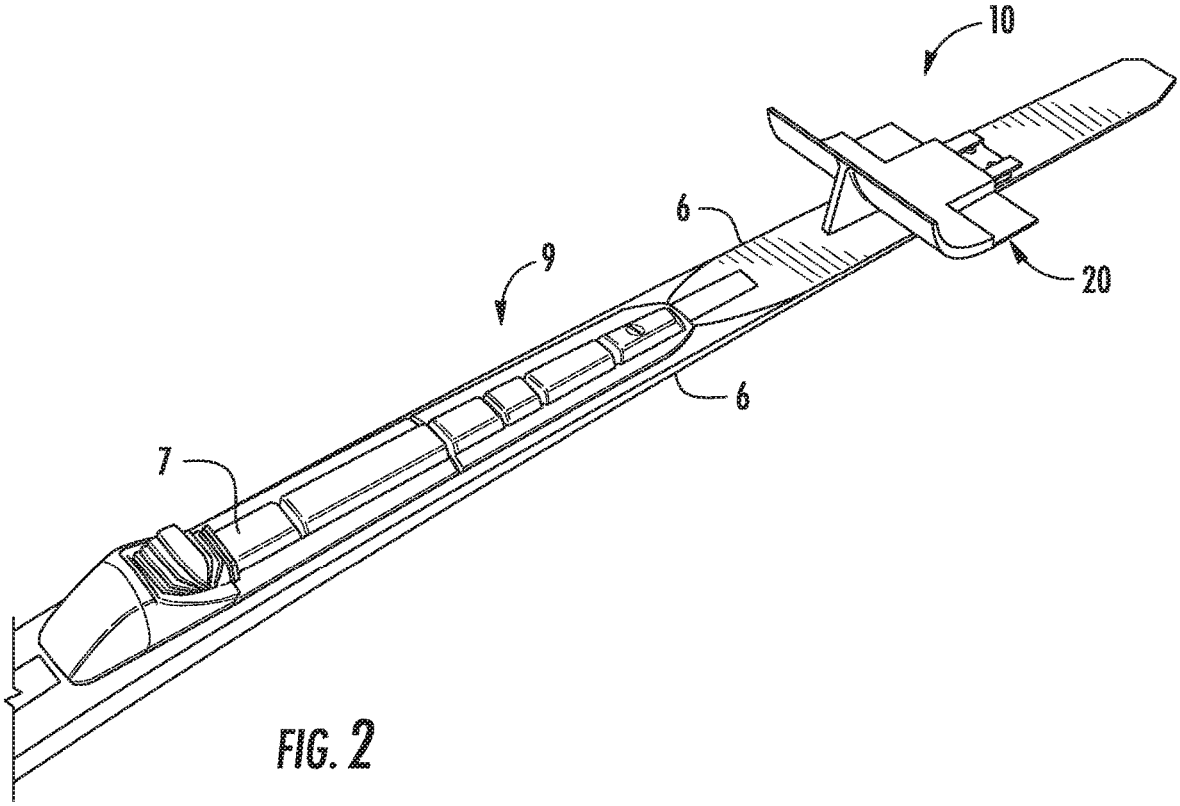
FIG. 2 shows a cross-country ski having one embodiment of the present invention connected thereto.
Figure 3:
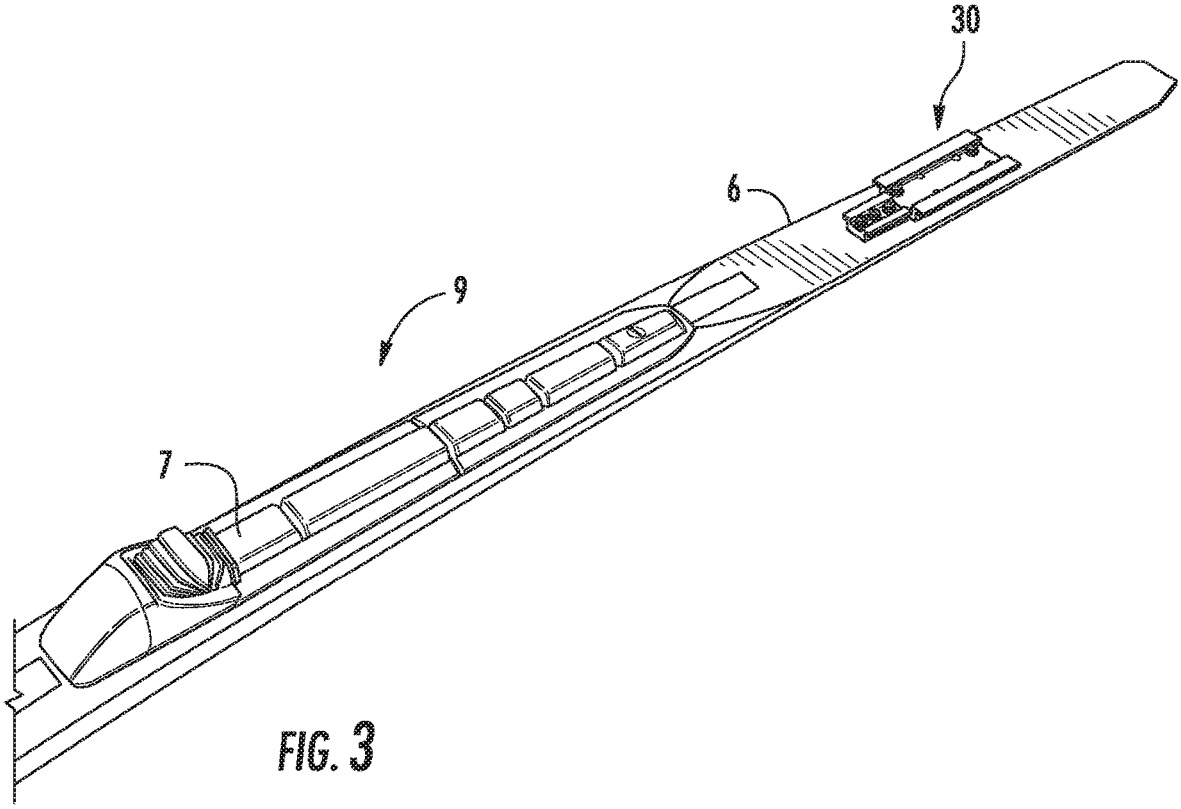
FIG. 3 shows the cross-country ski of FIG. 2 with the body portion of the present invention removed exposing a mounting bracket.
Figure 4A:
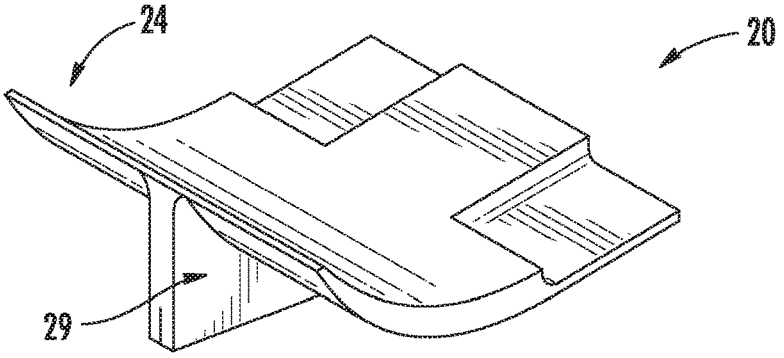
FIGS. 4A-4C detail one embodiment of the body portion the present invention.
Figure 4B:
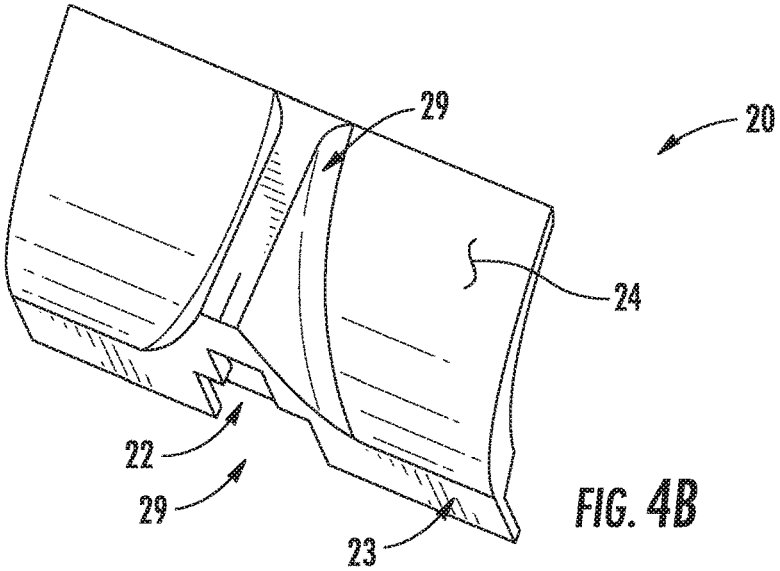
Figure 4C:
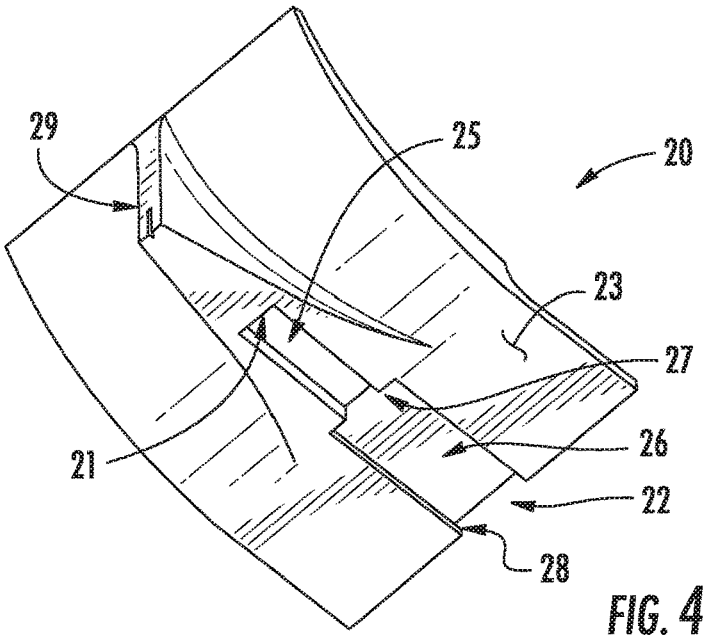
Figure 5A:
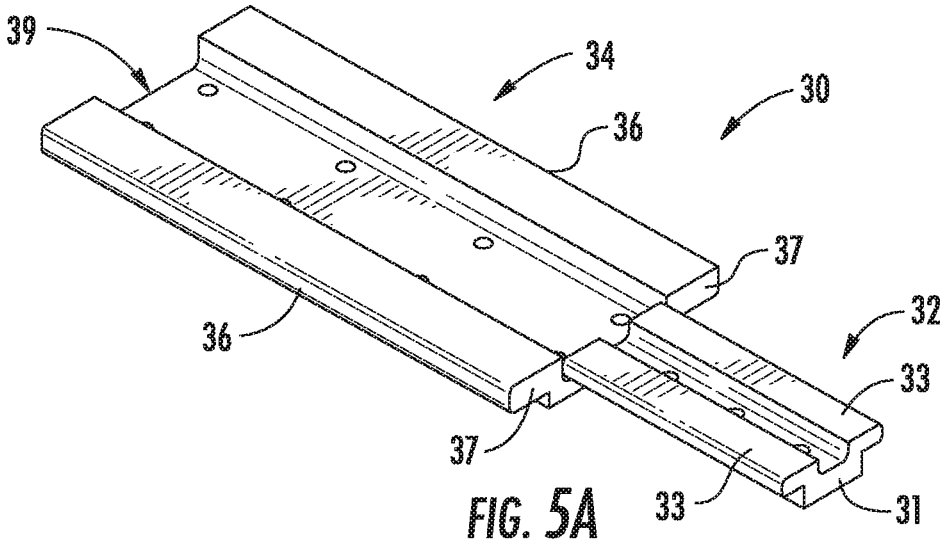
FIGS. 5A-5C detail one embodiment of the mounting bracket of the present invention
Figure 5B:
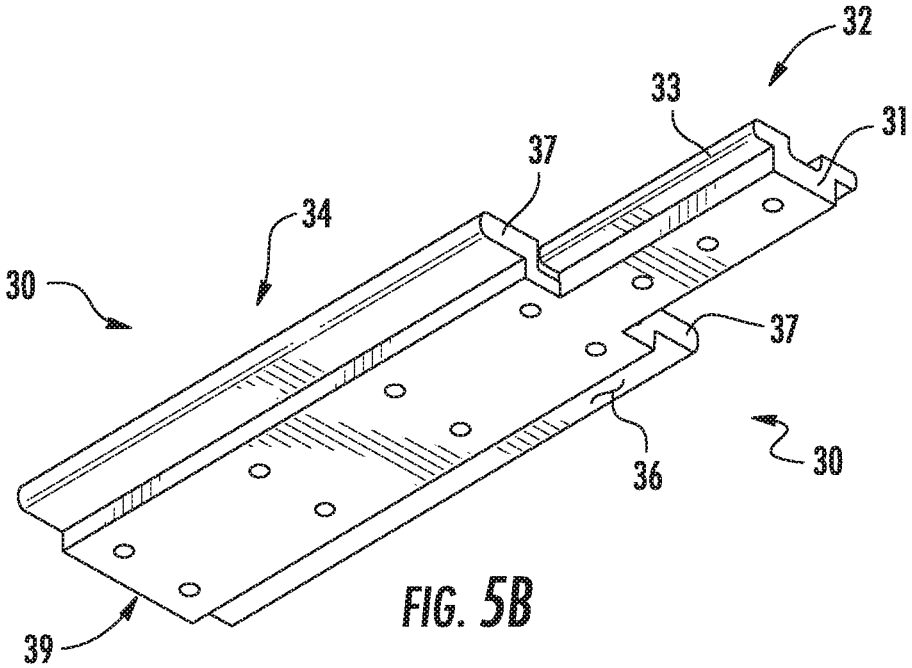
Figure 5C:
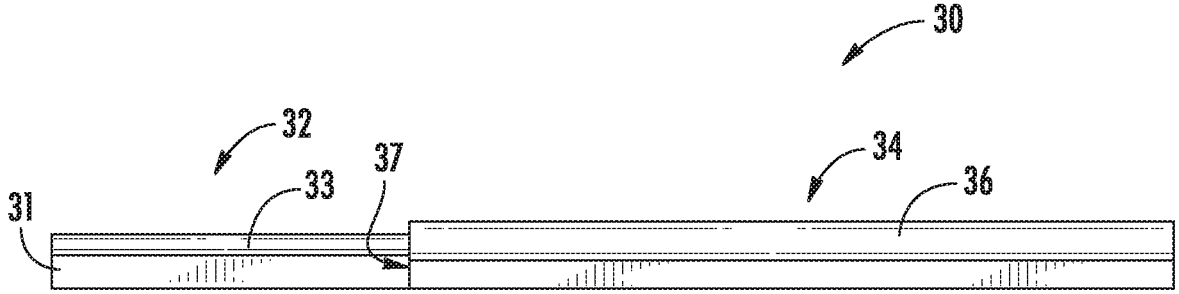

Many of the processes, means, and components utilized in this invention are widely known and used in the field of the invention described. Their exact nature or type is not necessary for an understanding and use of the invention by a person skilled in the art, and they will not therefore be discussed in significant detail. Furthermore, the various components shown or described herein for any specific application of this invention can be varied or altered as anticipated by this invention and the practice of a specific application of any element may already be widely known or used in the art by persons skilled in the art. The present invention is described as it applies to its preferred embodiments. It is not intended that the present invention as claimed be limited to the described embodiments.

Cross country skiing is often enjoyed when a ski track has been established in the snow. The track, typically comprising a pair of side-by-side parallel indentations in the snow, each having a width generally corresponding to that of a cross-country ski, to guide the skis along the tracks. Skiers can ski faster, and smoother compared to skiing on untracked snow. The tracks also guide the skier and allows the skier to enjoy the surrounding scenery with less concentration required to guide the skis. The profile of the ski track is also important. If the snow depth is deep, the tracks can be relatively deep which impede skier movement. Since the snow adjacent to the track formed by the skis alone remains undisturbed, skiing on the track is akin to skiing on a rail; if a ski is moved laterally off the track it sinks into the surrounding snow possibly upsetting the skier. For this reason, grooming cross-country ski tracks typically involves slight compaction of the snow on either side of the ski track itself. Known towed cross-country track groomers typically smooth or compact a swath that is significantly wider than the pair of ski tracks to avoid this issue.

To this end, the present invention provides an apparatus for grooming a cross-country ski track 1 in a snow-covered surface that forms not only a track for the ski, but also compresses snow adjacent to each side of the ski track to create a groomed track that is easier for a skier to follow. With the device installed on a lead skier's 5 ski, subsequent skiers benefit from and are guided by the packed snow on the either side of the lead skier's ski track as well as the compacted ski track itself.

Referring to the figures generally and FIGS. 2 through 5 specifically, the track grooming apparatus 10 comprises a body portion 20 and mounting bracket 30. The mounting bracket 30 is attached to the top of a cross country ski 9. The mounting bracket 30 is preferably longitudinally centered on the ski and may be positioned ahead of or behind the binding 7 where the skier's boot attaches. The mounting bracket 30 may also be incorporated into the ski binding 7 to minimize fixtures or appurtenances that are attached to the ski. The mounting bracket 30 is preferably no wider than the ski 9 and does not overhang the sides of the ski so that skiing with the body portion removed from the bracket is unaffected by the bracket on the ski. that are selectively connectible.

The body 20 is configured to overhang the sides 6 of the ski 9 and includes an upwardly turned forward section 24 that directs snow beneath the generally planar downward-facing surface 23 as the ski and body 20 are moved through the snow. The forward section 24 may further include a diverting structure or splitter 29 extending downwardly from the forward section 24 toward the bracket 30 to deflect any snow on the top of the ski laterally outwardly and underneath the downward-facing surface 23. The splitter 29 may be contoured to laterally deflect snow to the width of the bracket 30 or the ski so that any snow riding over the top of the ski is deflected to the side of the ski and under the downward-facing surface 23. The splitter 29 reduces drag on the ski caused by snow build-up on top of the ski ahead of the forward surface 24.

The connection between the body 20 and the bracket 30 comprises a channel 22 formed in the downward-facing surface 23 of the body 20 that is configured to slidingly receive a portion of the bracket 30. The bracket 30 may also include a first portion 32 and a second portion 34, the widths of each portion being different to create a stop structure 37. Each portion may be generally T-shaped having lateral extensions 33, 36 that engage corresponding structures in the channel 22 to restrain the body in a fixed position relative to the ski. The channel 22 includes a first portion 25 and a second portion 26 sized to receive the respective portions 32, 34 of the bracket 30, which creates a corresponding stop structure 27 in the channel 22. The channel is arranged to include an open end 28 on the rearward end of the body to permit sliding engagement of the bracket 30 into the channel 22. The rearward opening permits the body 20 to be engaged on the bracket 30 by a sliding movement toward the rear of the ski. The engaging movement is limited by interaction between the stop portions 27, 37.

The configuration of the bracket and channel interface is such that the body is engaged on the bracket by sliding in the rearward direction until the respective stop structures 27, 37 contact. An end 31 of the bracket 30 interacts with an end 21 of the channel 22 to also limit sliding engagement of the body on the bracket. The extent of the sliding movement between an initial position at which the bracket first enters the channel and the operable position at which the stop structures are in sufficient contact to assure that the body will not disengage from the bracket during normal ski motion. The force of impact with the snow as the ski moves is applied to move the body rearward thereby maintaining the stop structures in contact. Toolless removal is possible by sliding the body 20 forwardly relative to the ski and bracket 30 until the bracket 30 disengages from the channel 22.

Figure 8:
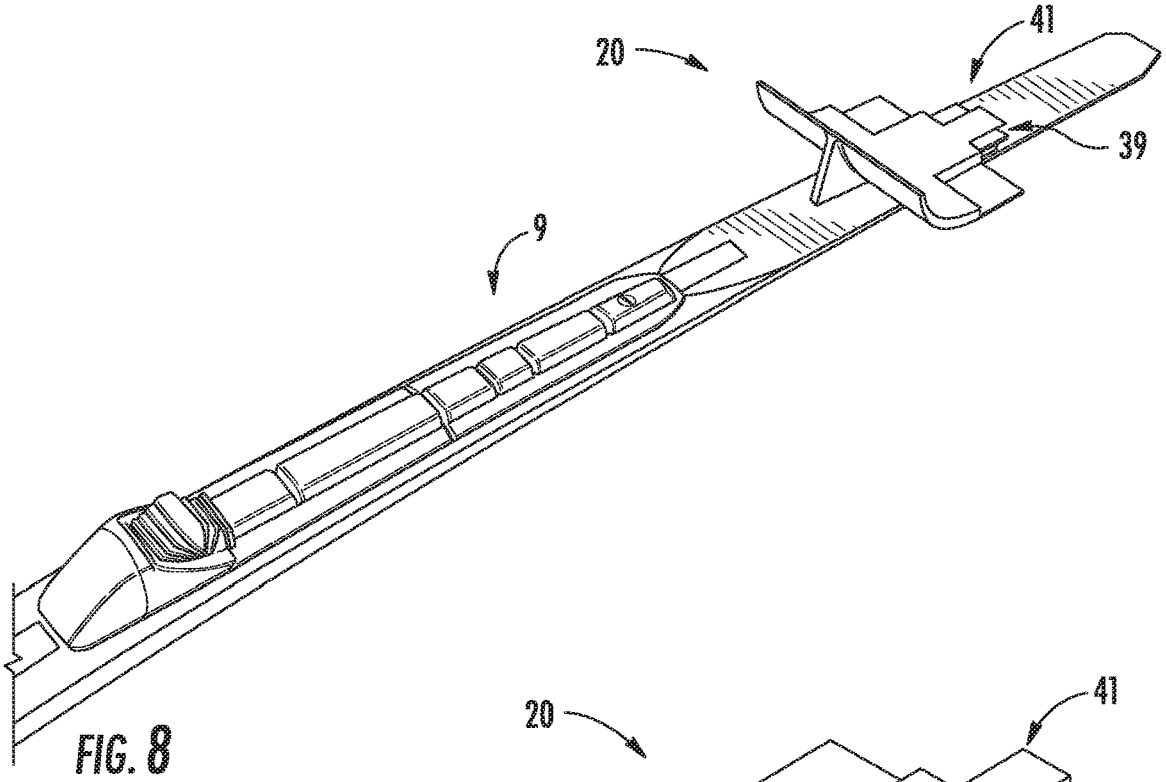
FIG. 8 shows a second embodiment of the present invention having a lock device for securing the body to the bracket.
Figure 9A:
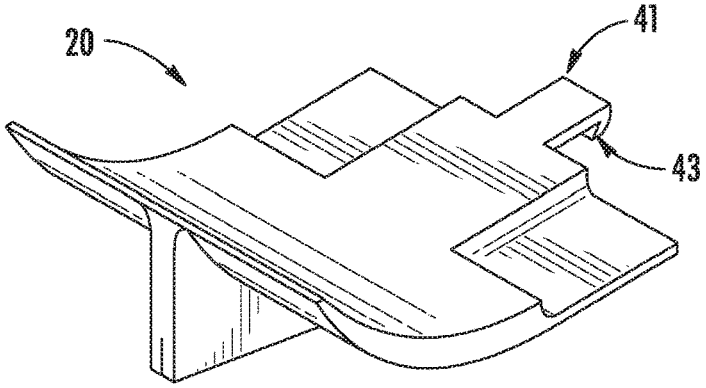
FIGS. 9A & 9B illustrate details of the lock device shown in FIG. 8.
Figure 9B:
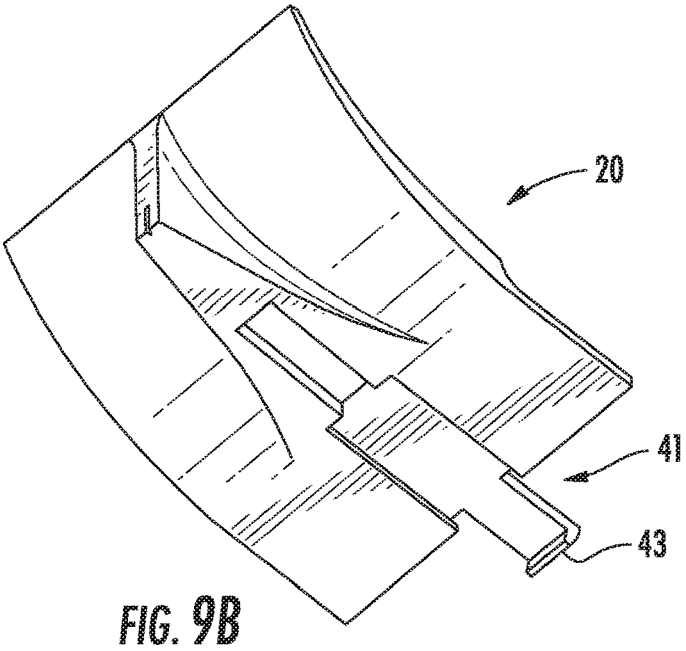

The connection between the body 20 and the bracket 30 may include additional features to prevent disengagement of the body 20 from the bracket 30 without user action. As best illustrated in FIGS. 8 and 9A-B, such features may include lock comprising a resilient member 41 with a ratchet 43 that engages a rear end of the bracket 30 when the body 20 is operably positioned on the bracket. Once engaged, the resilient member 41 must be deflected to disengage the ratchet from the bracket to allow the body to slide forward and disengage the bracket. The bracket 30 and/or the channel 22 may be tapered so that the fit therebetween tightens as the body is slid toward the operable position on the bracket.

Figure 6:
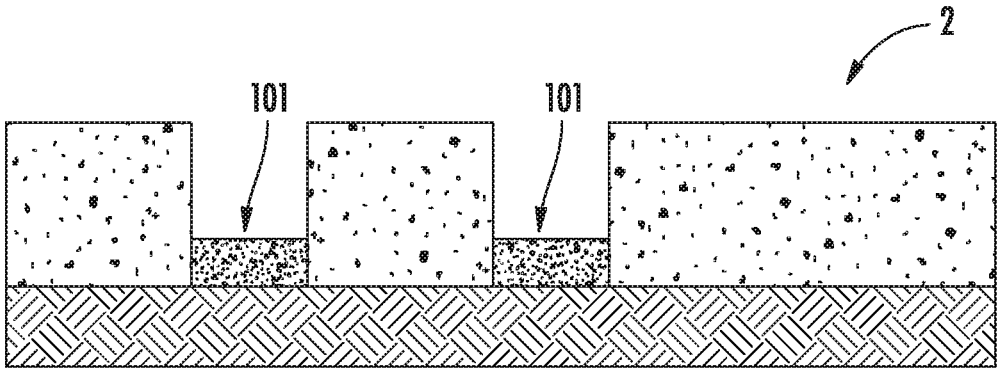
FIG. 6 (PRIOR ART)
FIG. 6 shows a cross-section of a snow-covered surface and the ski tracks formed by a skier using normal cross-country skis.
Figure 7:
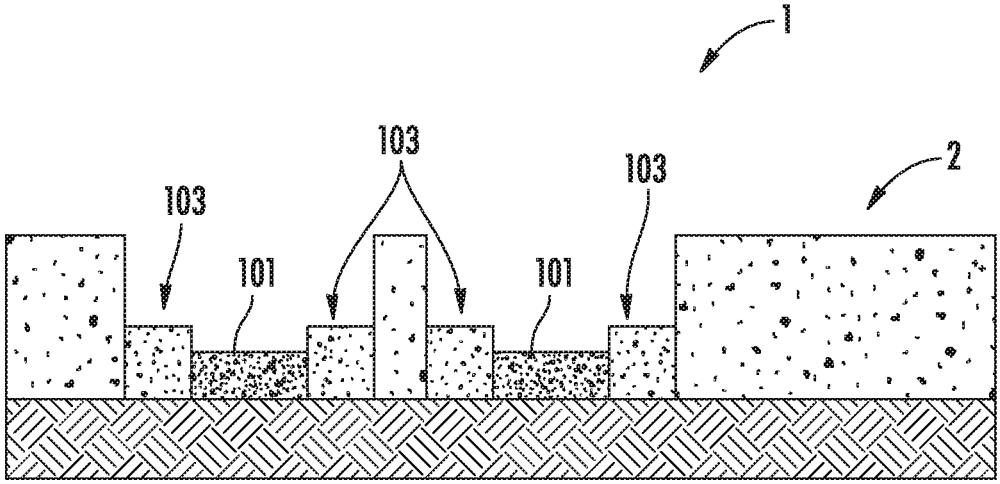
FIG. 7 shows a cross-section of a snow-covered surface and the ski tracks formed by a skier using cross-country skis with the present invention.

With the track grooming apparatus 10 installed, a skier can create a groomed cross-country ski track 1 simply by taking an initial pass along a snow-covered surface 2. Referring to FIGS. 6 and 7, snow directly beneath the skis is compacted as the skier passes to form a track groove 101 that is the width of the ski. Snow on either side of the track groove is slightly compacted as the portions of the body 20 that overhang the sides of the ski pass. This additional compacted zone 103 of slightly compacted snow is important to help guide subsequent skier's skis. When the snow on either side of the track groove is left undisturbed as it would be if only a cross-country ski passes (FIG. 6), subsequent skiers are effectively skiing on a rail of compacted snow. Skis departing the ski groove will sink further in the soft, uncompacted snow on either side of the ski groove 101 which can disrupt their skiing and lead to falls. Using the track grooming apparatus of the present invention creates an additional compacted zone 103 in the snow adjacent to the ski groove (FIG. 7). The result is a groomed ski track 1 that guides the skier's skis more like a trough. As the ski departs the ski groove it encounters compacted snow minimizing additional sinking of the ski into the snow and enables the skier to easily direct the ski back into the ski groove.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

I claim:

1. An apparatus for forming a cross-country ski track in a snow-covered surface comprising:

a sliding body having a generally planar surface portion which curves upwardly at a forward section thereof and having laterally spaced apart side edges defining a body width; and a bracket configured to removeably connect the sliding body to an upwardly facing surface of a cross country ski and position the side edges of the sliding body such that the side edges overhang laterally opposite sides of the cross-country ski and position the sliding body adjacent to the upwardly facing surface between opposing longitudinal ends of the cross-country ski.

2. The apparatus of claim 1, wherein the bracket is configured not to overhang the upwardly facing surface of the cross-country ski when in use.

3. The apparatus of claim 2, wherein the bracket comprises an extension laterally extending from a longitudinal central portion forming a generally T-shaped cross section.

4. The apparatus of claim 1, wherein the cross-country ski further includes a binding to which a skier's boot connects intermediately longitudinally positioned on the cross-country ski and the bracket is positioned forward or rearward of the binding.

5. The apparatus of claim 1, wherein the bracket is configured to be incorporated into a binding of the cross-country ski.

6. The apparatus of claim 1, wherein the sliding body further comprises a channel in the planer surface portion configured to slidingly receive at least a portion of the bracket, the channel further having an open end, the open end permitting sliding movement of the bracket into the channel, and a stop structure to limit the extent to which the bracket may slide into the channel thereby defining a fully engaged position of the sliding body on the bracket.

7. The apparatus of claim 6, wherein the channel is tapered in relation to the bracket to increase friction between the bracket and sliding body when the body moves toward the fully engaged position.

8. The apparatus of claim 1, wherein the sliding surface includes a splitter extending downwardly from the upwardly curved forward section toward the upwardly facing surface of the ski and configured to urge snow contacting the surface portion outwardly from the splitter toward the side edges when in use.

9. The apparatus of claim 1, further comprising a lock for releasably retaining the sliding body in the fully engaged position on the bracket.

10. The apparatus of claim 9, wherein the lock comprises a resilient catch disposed on the body that engaged a rearward end of the bracket.

11. A method for forming a cross-country ski track in a snow-covered surface comprising the steps of:

providing a sliding body having a generally planar surface portion which curves upwardly at a forward section thereof and having laterally spaced apart side edges defining a body width;

providing a bracket for removeably connecting the sliding body to a cross-country ski;

connecting the bracket to an upwardly facing surface of the cross-country ski in a position between opposing longitudinal ends of the cross-country ski;

sliding the body into connection with the bracket thereby positioning the sliding body adjacent to the upwardly facing surface between opposing longitudinal ends of the cross-country ski such that the side edges overhang laterally opposite sides of the cross-country ski; and skiing across a snow-covered surface, the cross-country ski and the sliding body forming a ski track in the snow as the cross-country ski moves in a forward direction.

12. The method of claim 11, wherein the sliding body further comprises a channel in the planer surface portion configured to slidingly receive at least a portion of the bracket, the channel further having an open end, the open end permitting sliding movement of the bracket into the channel, and a stop structure to limit the extent to which the bracket may slide into the channel thereby defining a fully engaged position of the sliding body on the bracket.

13. The method of claim 12, wherein the bracket comprises an extension laterally extending from a longitudinal central portion forming a generally T-shaped cross section.

14. The method of claim 13, wherein the channel is tapered in relation to the bracket to increase friction between the bracket and sliding body when the body moves toward the fully engaged position.

15. The method of claim 14, wherein the latch comprises a resilient catch disposed on the body that engaged a rearward end of the bracket.

16. The method of claim 11, wherein the sliding surface includes a splitter extending downwardly from the upwardly curved forward section toward the upwardly facing surface of the ski and configured to urge snow contacting the surface portion outwardly from the splitter toward the side edges when in use.

17. The method of claim 11, further comprising a lock for releasably retaining the sliding body in the fully engaged position on the bracket.

18. The method of claim 11, further comprising the steps of:

removing the sliding body from the bracket; and skiing normally with the bracket attached to the cross-country ski.

* * * * *